US005497512A

United States Patent [19]

Wright

[11] Patent Number: 5,497,512

[45] Date of Patent: Mar. 12, 1996

[54] BOW SHOOTING VEST AND BRACE

[76] Inventor: Thomas Wright, General Delivery, Lethbridge, Alberta, Canada, T1J 3Y2

[21] Appl. No.: 114,338

[22] Filed: Aug. 31, 1993

[30] Foreign Application Priority Data

Mar. 12, 1993 [CA] Canada ..... 2092681

[51] Int. Cl.[6] ..... A41D 1/04

[52] U.S. Cl. ..... 2/102; 124/31; 2/1

[58] Field of Search ..... 2/1, 102, 161.5; 124/31, 35.1, 35.2

[56] References Cited

U.S. PATENT DOCUMENTS

| | | | |
|---|---|---|---|
| 3,965,884 | 6/1976 | Killian | 124/35.2 |
| 5,203,314 | 4/1993 | Green | 124/35.2 |
| 5,205,268 | 9/1993 | Savage | 124/35.2 |

OTHER PUBLICATIONS

"A One–Armed Bowhunter" by Jude Mills, Archery Action with Outdoor Connections, May/Jun. 1989, pp. 22–23.

*Primary Examiner*—C. D. Crowder
*Assistant Examiner*—Larry D. Worrell
*Attorney, Agent, or Firm*—Sughrue, Mion, Zinn, MacPeak & Seas

[57] ABSTRACT

A one or two-piece garment generally contoured to conform to the shape of the human torso manufactured from a semi-rigid material such as leather or plastics, with an arched support fixed to the garment between the top front and top rear portions of said garment. Incorporated within the body of the arched support is an anchoring device, with a trigger style archery bow string release mechanism which permits a physically challenged person to draw an archery bow and then release the bow string and thus fully participate in the sport of bow shooting.

3 Claims, 3 Drawing Sheets

BOW SHOOTING VEST AND BRACE

BACKGROUND OF THE INVENTION

This invention relates to the sport of archery and, more specifically, the provision of an archery vest by which physically challenged individuals can participate fully in that sport.

The use of bow and arrow for both sport target shooting and hunting has been steadily gaining popularity. By its very nature, the operation of a bow and arrow requires considerable upper arm and chest strength and also the use of both arms. In the case of certain types of physical disabilities such as the loss or limited use of one arm, or limited strength in one arm archery and bow shooting has been closed to the vast majority of these physically challenged individuals.

While there has been development of devices designed specifically to enable physically challenged persons to participate in other forms of sporting activity, the field of archery has remained largely ignored.

SUMMARY OF THE INVENTION

To overcome these problems the present archery vest was developed to be worn by physically challenged individuals in order to permit them to safely and efficiently draw and release a bow and arrow mechanism.

The body portion of the vest may be of one or two piece construction and is generally contoured to conform to the shape of the human torso, rear of the vest. Incorporated within the arched support is an anchoring device with a trigger style bow string release mechanism which permits a physically challenged person to draw and then release a bow string.

The bow shooting vest and brace is of relatively simple construction and comfortable to wear. The shoulder strap anchor provides a consistent anchor point for the drawing of the bow string which allows the wearer to use his or her shoulder, chest and back muscles to draw the bow. Furthermore, the vest and brace are unobtrusive on the wearer's body.

Accordingly, the invention herein comprises a vest like garment generally contoured to approximate the shape of the human torso and comprising an archery bow string holding and release means mounted on a front portion of the shoulder strap.

BRIEF DESCRIPTION OF THE DRAWINGS

In drawings which illustrate embodiments of the invention.

DETAILED DESCRIPTION OF THE INVENTION

Figure 1:
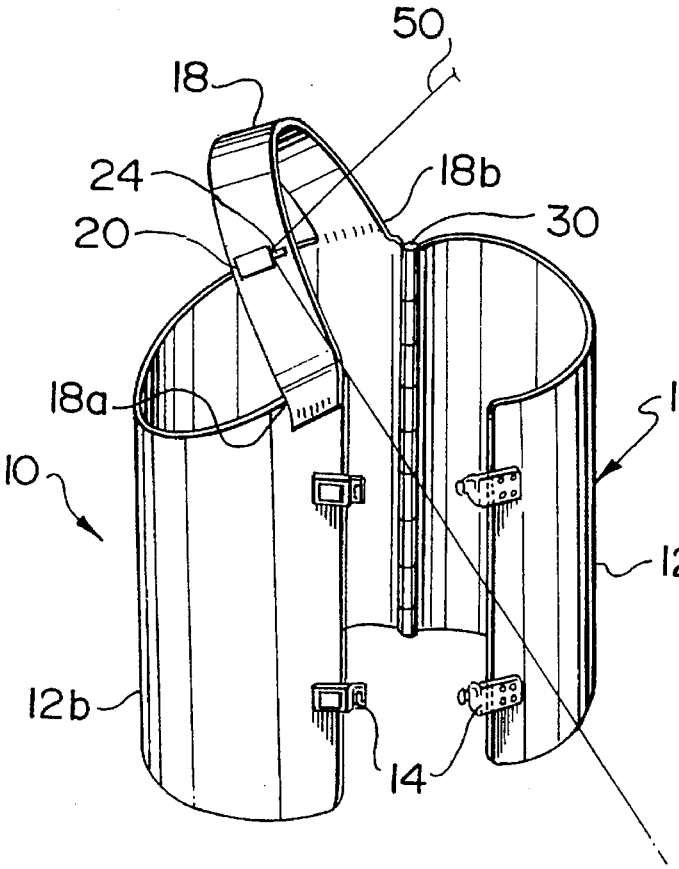
FIG. 1 is a perspective view of one embodiment of the invention.
Figure 3:
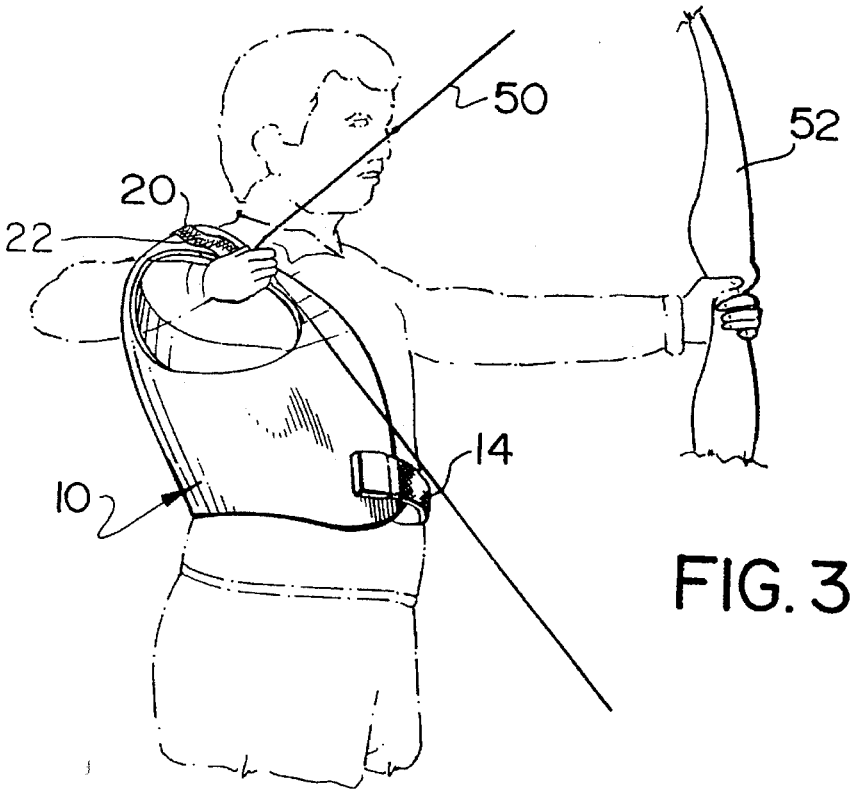
FIG. 3 is a side elevation of the second embodiment in operable position illustrating the bow string drawn.
Figure 2:
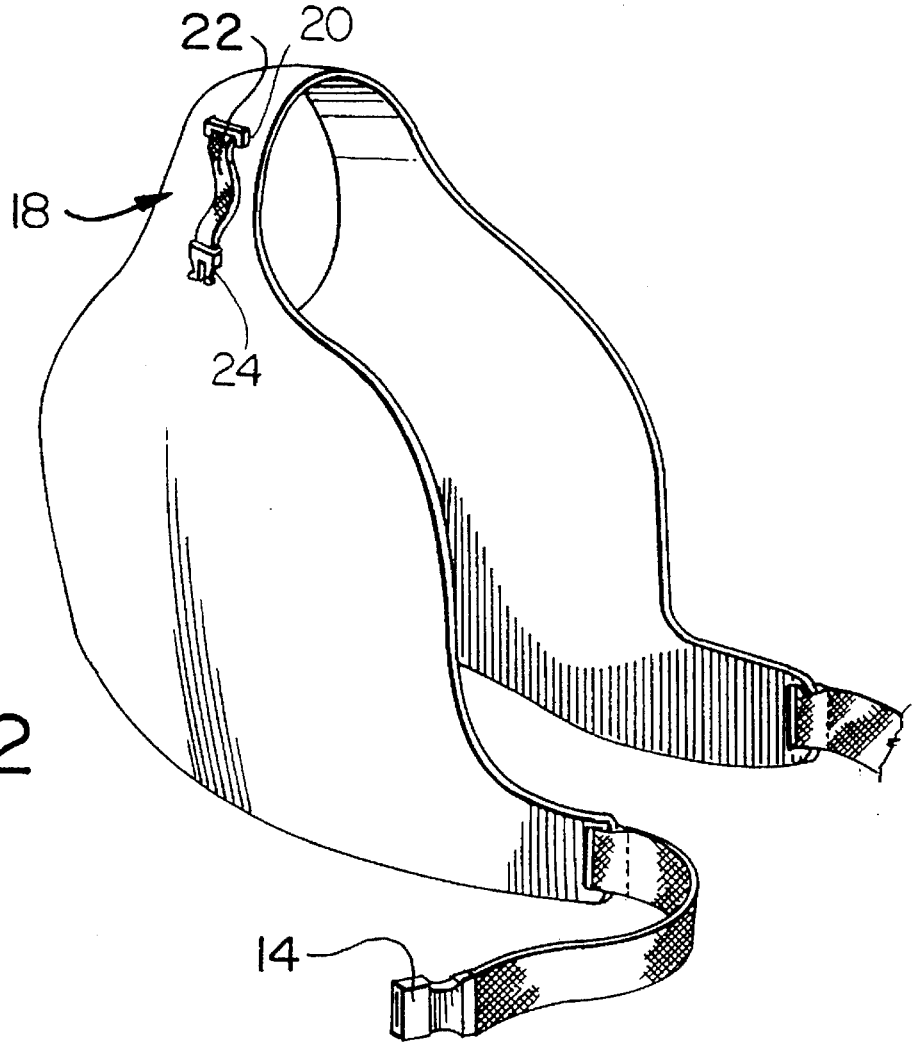
FIG. 2 is a perspective view of a second embodiment of the invention.
Figure 4:
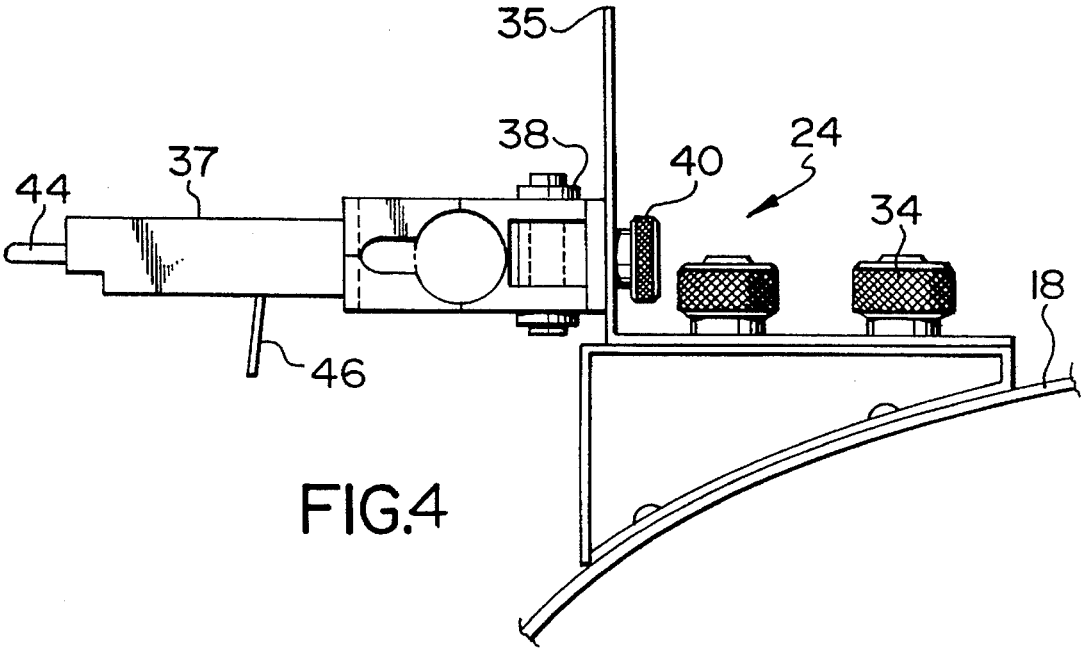
FIG. 4 is a side elevation of one type of trigger release mechanism.

The following is a description by way of example of a preferred embodiment of the present invention, reference being to the accompanying drawings. In one embodiment, the archery vest 10 is composed of a body portion 12 of semi-rigid or rigid material of uniform wall thickness and generally contoured to approximate the shape of the human torso and securely fastenable on the torso by a closing means 14 such as adjustable straps or buckles 14 which preferably buckle at waist level on one side of the user's torso as best seen in FIG. 2.

The shoulder strap of the vest 10 is composed of an arched support 18 which is formed between the top front 18*a* and top rear portions 18*b* of the body portion 12.

A trigger anchor 20 is affixed to the support 18 and is connected by a flexible strap 22 to a trigger release means 24. The trigger release means 24 may be affixed to either side of the arched shoulder support 18 thus accommodating either left or right handed operation.

The to body portion 12 may be comprised of two half shells 12*a* and 12*b* respectively, joined by hinge 30 at the rear such that each half shell, fully encloses the human torso when closed and secured by the closing means 14.

The string holding and release mechanism 24 is mountable on either the trigger anchor 20 or directly on support 18 at a preselected anchor position. The benefit of using a trigger anchor is that one vest may be used with any number of different release means, for example electronic or mechanically activated release means. In illustrated embodiments string holding and release mechanism 24 is mounted on anchor 20 either by strap 22 (FIG. 2) or by locking nuts 34 (FIG. 5). The string holding and release mechanism may comprise a generally L-shaped bracket 35 upon which a swivel bracket 38 is slidably mounted to permit both vertical adjustment and horizontal adjustment using locking screw 40. A mechanical release 37 is attached at the end of swivel bracket 38 and is provided with a protruding string holding and release means 44 and a trigger 46. The trigger 46 may be mechanically operated or with the addition of a solenoid switch operated electronically with a push switch, for example by foot.

Figure 5A:
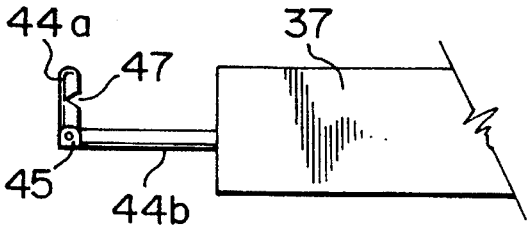
FIGS. 5A and 5B are top views, in detail, of the mechanical bow release of the trigger release means.
Figure 5B:
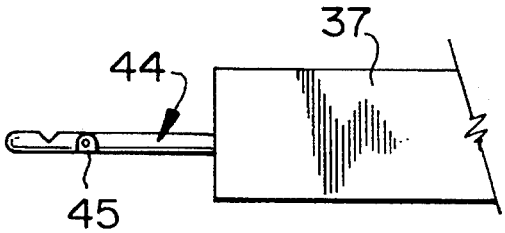

The string holding and release means 44 is composed of a first digit 44*a* and a second digit 44*b* joined by hinge 45. The first digit 44*a* is moveable between a primed position, as best seen in FIG. 5A and a release position, as best seen in FIG. 5B. The first digit 44*a* optionally may carry a string holding notch to better secure the bow string when in the primed position.

In operation the bowman uses the present invention by first loading an arrow into the bow and securing the bow string 50 around the tail of the arrow. The bow string 50 is then engaged with the holding and release means 44 such that the string is held firmly in place by the first digit 44*a* when in a primed position such that the bow 52 can be drawn by the bowman using only one arm.

When the string 50 is ready to be released, the bowman activates the trigger 46 such that the holding and release means 44 causes the first digit 44*a* to move from the primed position to the release position, causing bow string 50 to disengage and the arrow is propelled forwards with the bow string under tension.

It will of course be understood that the present invention has been described above purely by way of example and modifications of detail can be made without departing from the spirit thereof and within the scope of the invention as defined in the appended claims.

What is claimed is:

1. An archery vest comprising:

a body portion adapted to be secured around the torso of a person using the vest;

a shoulder strap portion attached to a front and rear of the body portion and adapted to extend over the user's shoulder when in use;

an anchor means located on a front portion of said shoulder strap such that the anchor is located on the front of the user's shoulder when the archery vest is in use; and a bow string holding and release mechanism mounted on said anchor means and including trigger means which, when actuated, release a bow string held by said bowstring holding and release mechanism.

2. The archery vest of claim 1, wherein said body portion is formed of two rigid or semi-rigid half shells joined by a hinge and adapted to close around said user's torso and be secured by interengaging closing means on the respective half shells.

3. The archery vest as claimed in claim 1, wherein said body portion is secured around said user's torso by means of adjustable straps and buckles.

* * * * *